US007857412B2

(12) United States Patent
Wada et al.

(10) Patent No.: US 7,857,412 B2
(45) **Date of Patent: *Dec. 28, 2010**

(54) INKJET RECORDING APPARATUS AND METHOD FOR CONTROLLING SAME

(75) Inventors: Satoshi Wada, Tokyo (JP); Hiromitsu Yamaguchi, Kanagawa-ken (JP); Hitoshi Yoshino, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 11/694,599

(22) Filed: Mar. 30, 2007

(65) Prior Publication Data

US 2007/0188533 A1 Aug. 16, 2007

Related U.S. Application Data

(63) Continuation of application No. 11/001,267, filed on Dec. 1, 2004, now Pat. No. 7,216,953.

(30) Foreign Application Priority Data

Dec. 2, 2003 (JP) ..... 2003-403737

(51) Int. Cl.
*B41J 29/38* (2006.01)
*B41J 29/393* (2006.01)

(52) U.S. Cl. ..... 347/17; 347/14; 347/19

(58) Field of Classification Search ..... 347/19, 347/14, 17

See application file for complete search history.

(56) References Cited

U.S. PATENT DOCUMENTS

| | | | | |
|---|---|---|---|---|
| 5,223,853 | A | 6/1993 | Wysocki | |
| 6,086,180 | A | 7/2000 | Sugimoto | |
| 6,145,951 | A | 11/2000 | Hayasaki et al. | |
| 6,227,643 | B1 | 5/2001 | Purcell | |
| 6,601,941 | B1 | 8/2003 | Jones et al. | |
| 7,201,460 | B1 * | 4/2007 | Silverbrook et al. | 347/14 |
| 7,216,953 | B2 * | 5/2007 | Wada et al. | 347/19 |
| 2002/0067384 | A1 | 6/2002 | Anderson | |

FOREIGN PATENT DOCUMENTS

| | | |
|---|---|---|
| EP | 0824243 | 4/1997 |
| JP | 03-054056 | 3/1991 |
| JP | 04-028553 | 1/1992 |
| JP | 07-052409 | 2/1995 |
| JP | 08-300644 | 11/1996 |
| JP | 11-005316 A | 1/1999 |
| WO | 01-89845 | 11/2001 |

* cited by examiner

*Primary Examiner*—Matthew Luu
*Assistant Examiner*—Jannelle M Lebron
(74) *Attorney, Agent, or Firm*—Canon USA Inc IP Div

(57) ABSTRACT

An inkjet recording apparatus includes a head assembly in which a plurality of head chips, each having multiple nozzles arranged therein for discharging ink, are disposed in the arrangement direction of the nozzles. The discharge of ink from the nozzles of each head chip in band-boundary regions in which bands recorded by the head chips overlap each other is adjusted in accordance with the detection result of the temperature of each head chip.

14 Claims, 10 Drawing Sheets

FIG. 6A
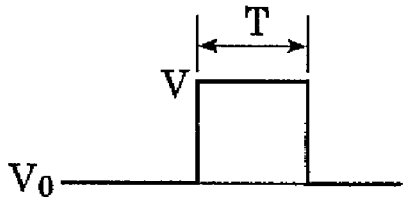
FIG. 6B
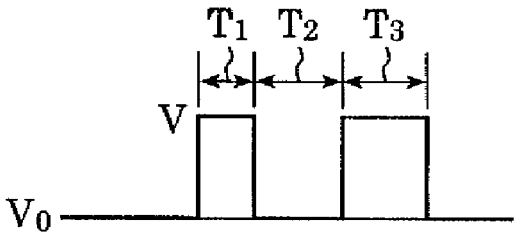
FIG. 7
| NOZZLE NO. | 1 | 2 | 3 | 4 | 5 | 6 | --------- | n-5 | n-4 | n-3 | n-2 | n-1 | n |
|---|---|---|---|---|---|---|---|---|---|---|---|---|---|
| AREA A | 0 | 0 | 1 | 1 | 1 | 0 | --------- | 1 | 0 | 1 | 1 | 0 | 0 |
| AREA B | 1 | 1 | 0 | 0 | 0 | 1 | --------- | 0 | 0 | 1 | 0 | 0 | 0 |

INKJET RECORDING APPARATUS AND METHOD FOR CONTROLLING SAME

CROSS REFERENCE TO RELATED APPLICATIONS

This is a continuation of co-pending U.S. application Ser. No. 11/001,267 filed Dec. 1, 2004, which claims priority from Japanese Patent Application No. 2003-403737 filed Dec. 2, 2003, all of which are hereby incorporated by reference herein in their entirety.

BACKGROUND OF THE INVENTION

1. Field of the Invention

The present invention relates to inkjet recording techniques in which recording is performed by discharging ink toward a recording medium from a long recording head (hereafter called a head assembly) obtained by connecting a plurality of head chips, each having multiple nozzles. More specifically, the present invention relates to an inkjet recording technique in which an image is recorded on a recording medium with a single scan of a head assembly relative to the recording medium (single-path method). The head assembly is obtained by disposing a plurality of relatively short head chips, each having multiple nozzles arranged therein, in the arrangement direction of the nozzles with high accuracy.

2. Description of the Related Art

In printers, printing apparatuses used in copy machines or the like, and printing apparatuses used as output apparatuses in workstations or complex electronic systems including computers and word processors, images (including characters and symbols) are printed on printing media, such as paper or thin plastic plates, on the basis of print information. The printing methods of these printing apparatuses are classified into an inkjet method, a wire-dot method, a thermal method, a laser beam method, etc.

An inkjet recording apparatus using the inkjet method is disclosed in, for example, Japanese Patent Laid-Open No. 8-300644.

Among various types of printing methods that are presently known, a typical printing apparatus using the inkjet printing method is a serial printing apparatus which performs printing by repeatedly moving a recording head having multiple nozzles arranged therein in a direction different from the arrangement direction of the nozzles. In the serial printing apparatus (also called a serial-scan printing apparatus), the entire region of a recording medium is printed on by repeating a main-scan recording step of forming an image by moving a print unit (recording head) along the recording medium in a main-scanning direction and a sub-scanning step of moving the recording medium by a predetermined distance each time a single scan is finished.

In such an inkjet printing apparatus (recording apparatus), normally, a band-shaped image region (hereafter called a band) is formed with a single scan, and ink spreads depending on the material and the surface state of the recording medium. Accordingly, irregular image regions called "connection lines" are formed in boundary regions between the bands.

As a recording method for eliminating the above-described irregular image regions, a multi-path method is known in which a single band is recorded with multiple scans. However, in the multi-path method, the number of times a recording head is moved relative to a recording medium is increased and the time required for recording the entire region of the recording medium is increased accordingly. As a result, the recording speed is reduced.

The connection lines between the bands can be eliminated without increasing the time for recording on the recording medium by using a recording apparatus including a long recording head in which nozzles are arranged over a distance longer than a dimension of the recording area. As an example of such an apparatus, a full-line (full multi) recording apparatus is known in which a recording head (full-line head or full multi head) having a length corresponding to the entire (or substantially entire) width of a recording medium is moved relative to the recording medium along the length of the recording medium. In the full-line recording apparatus, image printing is completed with a single scan, and the bands are not formed unlike the serial printing apparatus. Accordingly, in the full-line recording apparatuses, the above-described irregular image regions are not formed between the adjacent bands.

However, when the above-described long head is manufactured, it is extremely difficult to form the nozzles and print elements, such as piezoelectric elements and heating resistance elements, over the entire width of the recording area without any defects. For example, in full multi printers used in offices or the like to output photographic images on large paper, about 14,000 nozzles are required to print on A3-sized paper with a resolution of 1,200 dpi (recording width is about 280 mm). It is difficult to form inkjet print elements corresponding to such a large number of nozzles without any defects in view of the manufacturing process thereof. Even if it is possible to manufacture such a print head, the percentage of defects is high and extremely high costs are incurred.

Accordingly, inkjet recording apparatuses having the structure of line printers including full multi print heads have been suggested. For example, Japanese Patent Laid-Open No. 3-54056 discloses a recording apparatus using a head obtained by connecting a plurality of head chips (also called nozzle chips).

FIGS. 3 and 4 are schematic diagrams showing examples of heads obtained by connecting a plurality of head chips (also called nozzle chips). Multiple nozzles are arranged in each of the head chips. The head chips are linearly disposed in the arrangement direction of the nozzles in the example shown in FIG. 3, and are disposed in a staggered pattern in the example of FIG. 4.

The above-described head (hereafter called a head assembly) is obtained by arranging a plurality of short, relatively inexpensive head chips that are commonly used in serial recording apparatuses with high accuracy. The number of nozzles formed in a single head chip is smaller than that in a single long head, and therefore the percentage that defective nozzles are present in the head chip is low. Thus, the percentage of defects is lower than that in the case of manufacturing a head having an integral structure with a plurality of nozzles arranged therein. In addition, only the head chips having defects are treated as defective parts, and therefore the manufacturing cost of the head is reduced.

Accordingly, a full-line recording apparatus can be relatively easily manufactured when the head assembly structured as described above is used as a full-line head that records over the entire width of the recording medium. In addition, when the head assembly is used in a serial recording apparatus, the width of a band recorded with a single scan is increased and the number of boundaries between the bands appearing in the image recorded on a single recording medium is reduced accordingly. Therefore, the irregularity of the image is reduced and the recording speed is increased at the same time.

However, when the head assemblies structured as shown in FIGS. 3 and 4 are used, the amount of heat generation varies between the chips due to the structure thereof, and accordingly the temperature varies between the chips.

On the other hand, a bubble jet recording method in which ink is discharged using heat is known as an example of the inkjet method. In the bubble jet recording method, bubbles are generated in the ink by heating the ink, and the ink is discharged though the nozzles by the pressure applied when the bubbles are generated. The above-described problem of variation in heat generation is particularly crucial in the bubble jet recording method.

With respect to the temperature distribution in each head chip used in the above-described bubble jet method or the heat transfer method, the head chip is normally formed on a silicon substrate, which has very high thermal conductivity, by a semiconductor manufacturing process or photolithography. In addition, the size of each head chip (short chip) included in a full line head is about 0.5 inches. Under these conditions, the temperature distribution in each chip becomes uniform in a relatively short time. However, in the head assembly including a plurality of head chips, the head chips are formed independently of each other and are separated from each other in the example shown in FIG. 4. Therefore, heat is transmitted between the head chips via a base plate composed of, for example, alumina, carbon, aluminum metals, etc., to which the head chips are adhered, and the temperature variation between the head chips is too large to be ignored when the head assembly is used. This problem does not occur when the recording head having an integral structure with all of the nozzles formed therein is used.

In the inkjet recording head, the volume of a single ink drop discharged from a nozzle generally varies depending on the temperature, and the difference in the volume of the ink drop appears in the image on the recording medium as a density difference. Accordingly, the temperature variation between the head chips appears as the density variation between the image regions corresponding to the head chips, and is visualized as band-shaped regions in the image.

In the case in which recording is performed using a serial scan recording apparatus including the head assembly by a single-path method in which an image is recorded with a single scan, head chips that are most distant from each other in the head assembly form an image region at the boundary between the bands. Since the head chips are influenced by the distance therebetween with regard to the heat diffusion in the head, a large density difference is generated in the region between the bands.

SUMMARY OF THE INVENTION

In view of the above-described problems, an object of the present invention is to provide a technique for preventing the "connection lines" from being formed at boundaries between the bands due to the temperature variation between the head chips when single-path recording is performed using a head assembly.

In order to solve the above-described problems and achieve the object, the present invention is applied to an inkjet recording apparatus which includes a long recording head (head assembly) obtained by disposing a plurality of head chips (short chips) adjacent to each other and which records an image with ink drops discharged from the head chips, each head chip having multiple nozzles for discharging ink and thermal-energy-generating elements (heating elements) for generating thermal energy to discharge the ink and the head chips being disposed in the arrangement direction of the nozzles. The inkjet recording apparatus according to the present invention includes a detecting unit for detecting the temperature of each of the thermal-energy-generating elements and an adjusting unit for adjusting the discharge of the ink on the basis of the detected temperature of each of the head chips disposed adjacent to each other.

In addition, according to an inkjet recording method of the present invention, an image is recorded with ink drops discharged from a plurality of head chips disposed adjacent to each other in a recording head, each head chip having multiple nozzles for discharging ink. The method includes a detecting step of detecting the temperature of each of thermal-energy-generating elements disposed in each head chip for generating thermal energy to discharge the ink and an adjusting step of adjusting the discharge of the ink on the basis of the detected temperature of each of the head chips disposed adjacent to each other.

The above-described apparatus or method may further include an obtaining unit (step) for obtaining the amount (increase) of discharge of the ink caused by the temperature increase in each head chip on the basis of the detected temperature. In this case, the adjusting unit (step) controls the discharge of ink from the nozzles of each head chip in boundary regions between the adjacent head chips on the basis of the obtained the amount of discharge.

The above-described apparatus or method may further include an estimating unit (step) for estimating a temperature to which the temperature of each head chip is increased on the basis of print duty of each head chip corresponding to the image to be recorded and a obtaining unit (step) for obtaining the amount of ink discharged from each head chip on the basis of the estimated temperature. In this case, the adjusting unit (step) controls the discharge of the ink from the nozzles of each head chip in the boundary regions between the adjacent head chips on the basis of the calculated change in the amount of discharge.

In the above-described apparatus or method, the adjusting unit (step) may change the number of ink drops discharged from the nozzles of each head chip in the boundary regions between the adjacent head chips.

In addition, in the above-described apparatus or method, the adjusting unit (step) may change the number of nozzles of each head chip from which the ink is discharged in the boundary regions between the adjacent head chips.

In addition, in the above-described apparatus or method, the adjusting unit (step) may change the volume of each of the ink drops discharged from the nozzles of each head chip in the boundary regions between the adjacent head chips.

In addition, in the above-described apparatus or method, the adjusting unit (step) may change the volume of each ink drop by adjusting a voltage of an electric signal applied to each nozzle or a time for which the electric signal is applied (e.g., a pulse width of a pulse signal).

In the inkjet recording apparatus according to the present invention, the temperature of each head chip may be detected and the discharge of the ink may be adjusted only when the temperature difference between the adjacent chips is equal to or greater than a predetermined value.

In addition, the inkjet recording apparatus may further include a medium checking unit for determining the kind of the recording medium and a changing unit for changing the predetermined value for evaluating the temperature difference between the adjacent chips depending on the kind of the recording medium.

In the present specification, the term "print" refers not only to a process of recording significant information such as characters and figures, but also to a process of forming images, designs, patterns, etc., on a recording medium or processing the recording medium irrespective of whether they are significant or visible to human eyes.

In addition, the term "recording medium" refers not only to paper which is commonly used in inkjet recording apparatuses but also to cloth, plastic films, metal plates, etc., which are capable of receiving ink discharged from the head.

In addition, the term "ink" refers to liquid applied to the recording medium for forming images, designs, patterns, etc., on the recording medium or processing the recording medium, and is to be interpreted broadly similar to the term "print".

As described above, according to the present invention, recording is performed by a single-path method using a long head assembly obtained by disposing a plurality of head chips, each having multiple nozzles arranged therein, in the arrangement direction of the nozzles, and the discharge of the ink is controlled on the basis of the temperature detected for each head chip or heater board. Accordingly, the degree of "connection lines" in the boundary regions between the bands is reduced and the print quality of the image obtained by the head assembly is increased.

Further objects, features and advantages of the present invention will become apparent from the following description of the preferred embodiments with reference to the attached drawings.

BRIEF DESCRIPTION OF THE DRAWINGS

FIGS. 6A and 6B are diagrams showing drive pulse signals used for driving the bubble jet head.

FIG. 7 shows a table using which a drive pulse signal is selected.

DESCRIPTION OF THE EMBODIMENTS

Embodiments of the present invention will be described in detail below with reference to the accompanying drawings.

In the embodiments described below, an inkjet recording apparatus (inkjet printer) is explained as an example. The embodiments described herein are merely examples in which the present invention is realized, and various modifications are possible within the scope of the present invention.

Figure 8:
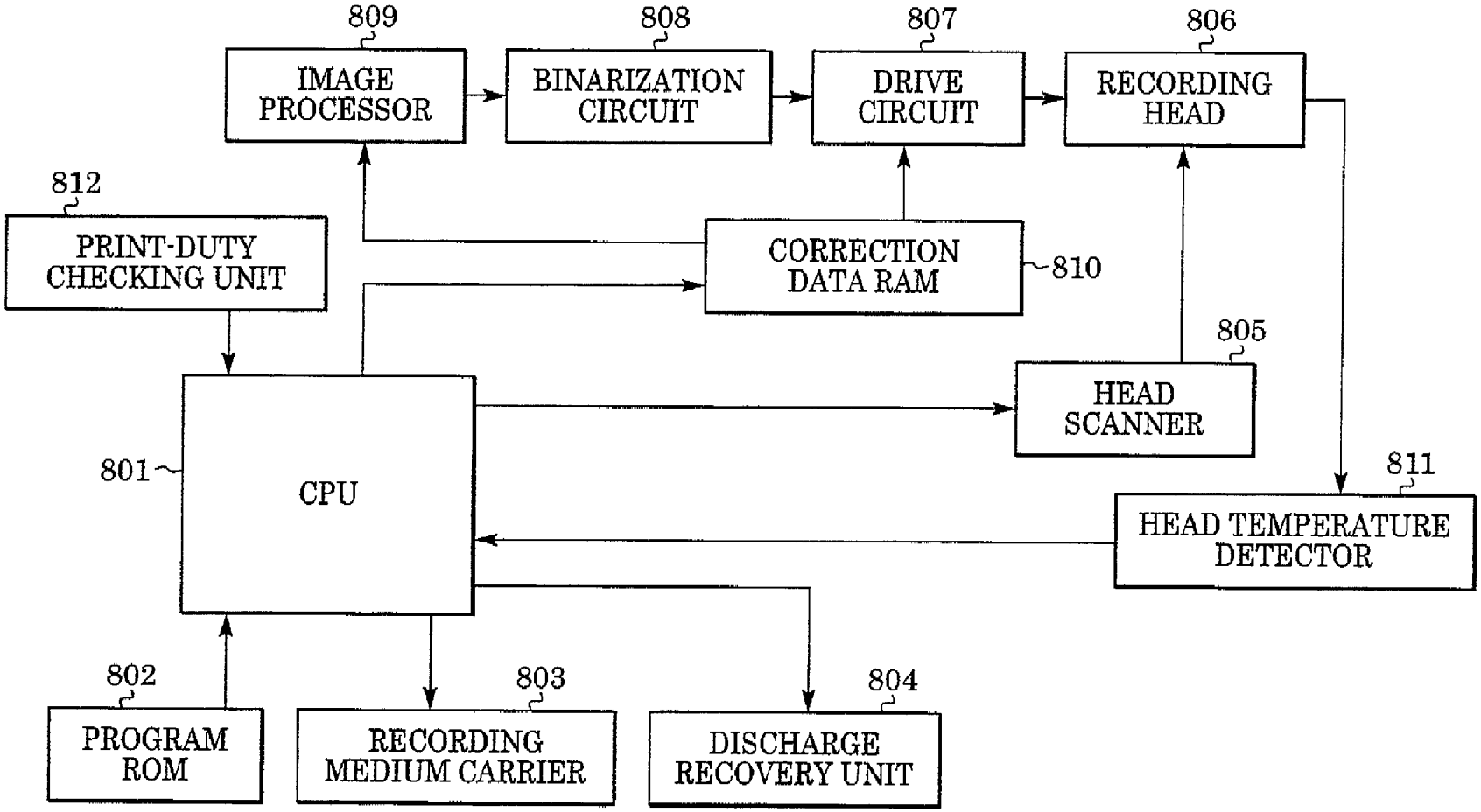
FIG. 8 is a block diagram of an inkjet recording apparatus according to an embodiment of the present invention.

FIG. 8 is a system block diagram of an inkjet printer. With reference to FIG. 8, the system includes a CPU 801 which controls the overall system; a ROM 802 which stores a software program for controlling the system; a carrier 803 which carries a recording medium, such as a piece of paper and an OHP film; a discharge recovery unit 804 which performs a head recovery process; a head scanner 805 which moves a head 806; the head 806; a drive circuit 807 which performs discharge control of the head 806; a binarization circuit 808 which converts an image to be recorded into discharge data (halftone process and the like are performed here); an image processor 809 which performs color separation when the image is in color; and a RAM 810 which stores data required in the discharge control of nozzles corresponding to boundaries between bands (hereafter called band-boundary nozzles).

The recording head 806 shown in FIG. 8 is a head assembly including a plurality of head chips. In addition, a temperature detector 811 detects the temperature of each head chip included in the recording head 806. The temperature of each head chip detected by the temperature detector 811 is analyzed by the CPU 801, and data necessary for the discharge control is read out from the RAM 810 as necessary.

When the amount of discharge is to be changed in the discharge control, the drive circuit 807 is controlled so as to change a driving voltage or the time for which a driving signal is applied. In addition, when the number of ink drops discharged in the band boundary regions is to be changed, the CPU 801 causes the image processor 809 to modify the image data corresponding to the band-boundary nozzles.

In FIG. 8, a print-duty-checking unit 812 checks the print duty of each head chip for printing an image in advance.

The CPU 801 performs the discharge control of the band-boundary nozzles in each head chip on the basis of the result obtained by the print-duty-checking unit 812 and the data stored in the RAM 810. The control method is similar to that described above. Although the system shown in FIG. 8 includes both the temperature detector 811 and the print-duty-checking unit 812, the present invention may also be realized by a system including only one of them. The discharge control is, of course, performed more precisely using a system including both the temperature detector and the print-duty-checking unit.

Next, each embodiment of the present invention will be described below with reference to the drawings.

First Embodiment

According to a first embodiment, a bubble jet head is used for discharging ink, and the volume of ink drops is changed by a discharge control unit on the basis of temperature data obtained by detecting the temperature of each head chip or heater board.

Figure 1:
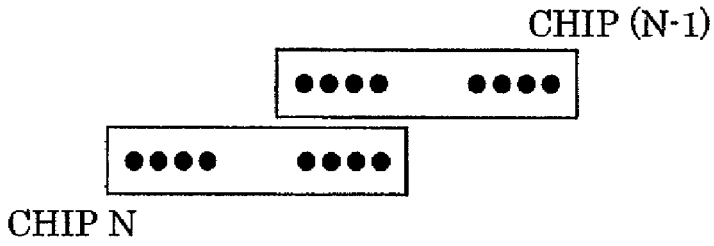
FIG. 1 is a diagram showing a recording head including head chips which are connected to each other.

In addition, a head assembly is structured such that two short chips are shifted from each other in a direction orthogonal to the arrangement direction of the nozzles and the chips overlap each other by at least one nozzle in the arrangement direction of the nozzles, as shown in FIG. 1.

Figure 2:
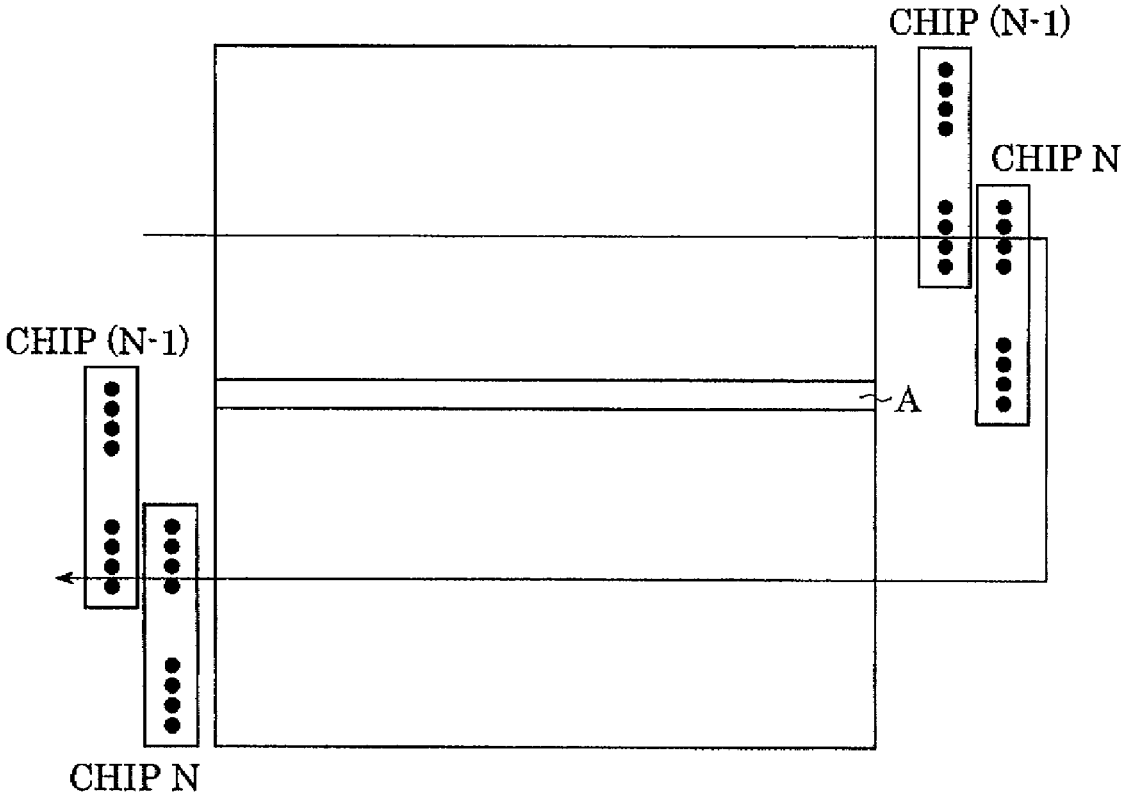
FIG. 2 is a diagram showing the manner in which an image is formed by the single-path method using a serial-scan recording apparatus including a head assembly.
Figure 3:
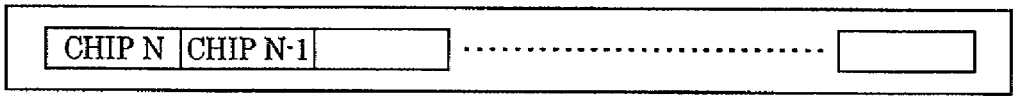
FIGS. 3 and 4 are diagrams showing examples of head assemblies.
Figure 4:
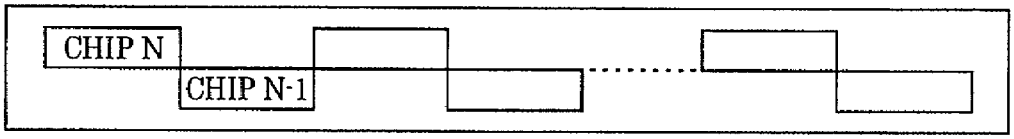

The manner in which an image is recorded on a recording medium using this head by the single path method is shown in FIG. 2. In FIG. 2, a region denoted by A shows a band boundary region which is printed twice during two successive scans of the recording head. In this example, the band boundary region A is printed twice by nozzles at the bottom of the chip N in the first scan and nozzles at the top of the chip (N-1) in the next scan.

Next, a basic discharge operation of a bubble jet head, which is an example of the inkjet head, will be described below.

In the bubble jet head, ink is rapidly heated by, for example, heaters (also called heating resistance elements) and ink drops are discharged by the pressure applied when bubbles are generated.

Figure 5:
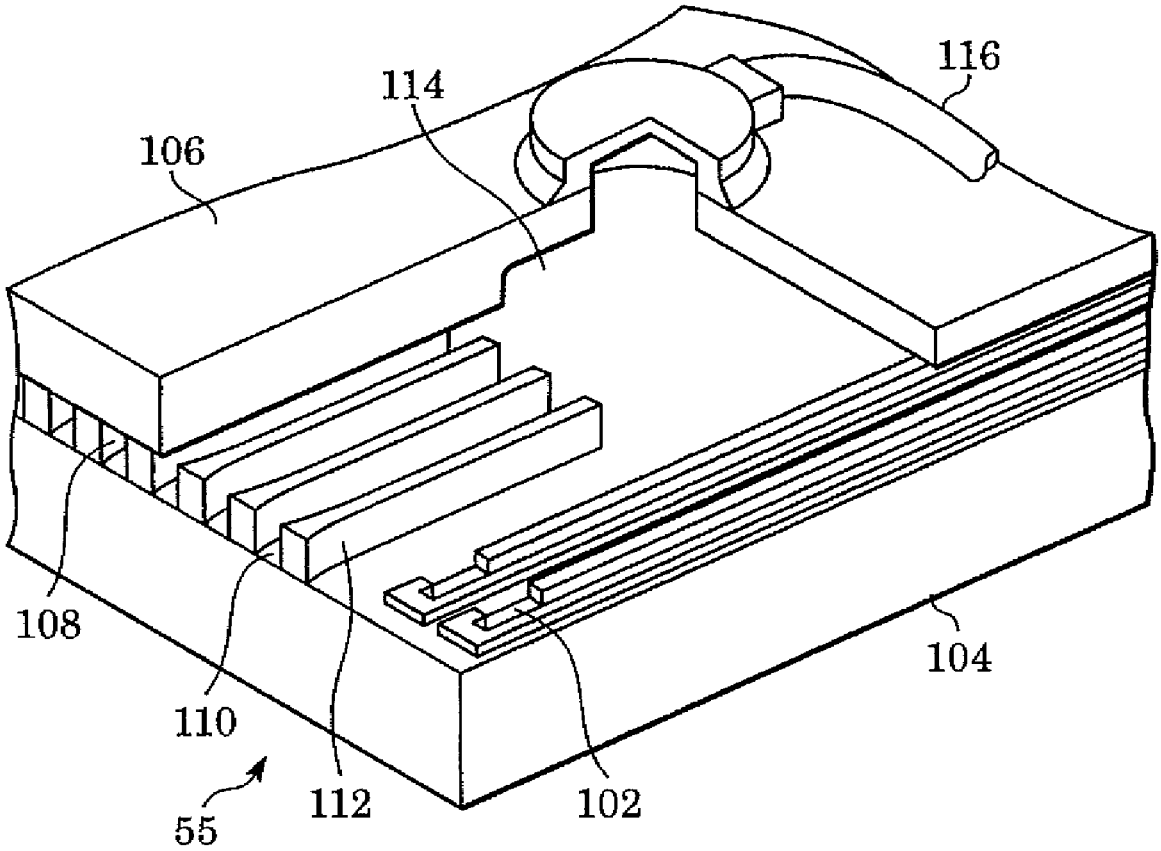
FIG. 5 is a diagram showing the structure of a bubble jet head.

FIG. 5 shows the structure of a bubble jet head to which the head chips according to the present embodiment may be applied.

A head 55 shown in FIG. 5 includes a heater board 104 defined by a base plate on which multiple heaters 102 for heating ink are provided and a top plate 106 placed on the heater board 104 to cover the heater board 104. The top plate 106 has multiple nozzles 108 formed therein, and tunnel-shaped paths 110 communicating with the nozzles 108 are provided behind the nozzles 108. Each path 110 is separated from the adjacent paths 110 by separation walls 112, and is connected to a single common ink cell 114 at the back end thereof. Ink flows into the ink cell 114 through an ink supply hole 116, and is supplied to each of the paths 110 from the ink cell 114.

The heater board 104 and the top plate 106 are positioned relative to each other such that the paths 110 face their respective heaters 102, and are attached together as shown in FIG. 5.

Although only two heaters 102 are shown in FIG. 5, one heater 102 is provided for each of the paths 110. When a predetermined drive pulse signal is applied to the heaters 102 in the assembled state shown in FIG. 5, ink near the heaters 102 is rapidly heated and bubbles are generated. Accordingly, the ink is discharged from the nozzles 108 due to the pressure applied when the bubbles expand.

This is the discharge principle of the bubble jet head.

The heater board 104 shown in FIG. 5 is manufactured by a semiconductor process using a silicon substrate as a base, and signal lines for driving the heaters 102 are connected to the drive circuit provided on the substrate. Accordingly, when a circuit, such as a diode sensor circuit, for detecting the temperature is additionally formed on the substrate in the manufacturing process, the temperature of the heater board (element substrate) or each head can be detected. Then, the above-described paths and nozzles are formed in the element substrate, and the head chip is completed. In the present embodiment, it is more convenient to detect the temperature of the nozzles corresponding to the band boundary regions for the discharge control performed afterwards, and therefore diode sensor circuits for temperature detection are preferably disposed at the ends of each head chip.

Next, a method for controlling the amount of ink discharged from the bubble jet head will be described below.

As described above, in the bubble jet head, bubbles are generated in the ink by rapidly heating the ink with the heaters, and the ink is discharged though the nozzles by the pressure applied when the generated bubbles expand. Therefore, the size of the bubbles and the speed at which they expand can be changed by controlling the drive pulse signal applied to the heaters. Accordingly, the volume of each ink drop being discharged can be controlled by controlling the drive pulse signal.

FIGS. 6A and 6B show examples of drive pulse signals applied to the above-described heaters. FIG. 6A shows a pulse signal used in "single-pulse driving" in which a single rectangular pulse is applied, and FIG. 6B shows a pulse signal used in "double-pulse driving" in which a plurality of pulses separated from each other are applied. In the single-pulse driving shown in FIG. 6A, the amount of discharge can be controlled by changing either a voltage ($V-V_0$) or a pulse width (T). In addition, in the drive control using the pulse signal with multiple separated pulses, the control width of the amount of discharge is increased compared to the single-pulse driving shown in FIG. 6A and the efficiency is increased accordingly.

In FIG. 6B, $T_1$ represents the width of a pre-pulse applied first (pre-pulse width), $T_2$ represents an off-period between the pulses, and $T_3$ represents the width of a main pulse applied for discharging the ink (main pulse width). The major part of heat emitted from the heaters for discharging the ink is absorbed by portions of the ink that are in contact with the surfaces of the heaters. Accordingly, in the double-pulse driving using the pulse signal shown in FIG. 6B, the ink is somewhat heated by applying the pre-pulse first, and thereby the pre-pulse helps the generation of the bubbles when the main pulse is applied. Thus, the double-pulse driving is more efficient in the discharge amount control compared to the single-pulse driving.

In the above-described double-pulse driving, the amount of discharge from the nozzles corresponding to the band boundary regions can be adjusted by setting the main pulse width $T_3$ constant and changing the pre-pulse width $T_1$. More specifically, the amount of discharge increases as the width $T_1$ increases and decreases as the width $T_1$ decreases.

Next, an example in which the amount of discharge is controlled for each nozzle by assigning different pre-pulse widths $T_1$ to the nozzles in the double-pulse driving will be described below.

As shown in FIG. 7, 2-bit data corresponding to each nozzle is stored in areas A and B of the RAM (correction data RAM 810) provided in the system board for controlling the inkjet head. Four kinds of pulses $PH_1$ to $PH_4$ (denoted by 9*a* to 9*d* in FIG. 9) having different pulse widths can be selected in accordance with the 2-bit data.

For example, when the data of a nozzle (N-1) is (1,0) and the pulse $PH_2$ is selected for this nozzle, the pulse $PH_3$ is selected for a nozzle N with the data of (0,1) which corresponds to the connecting region. Thus, the amount of discharge can be varied by setting the bit data for selecting the pre-pulse for each nozzle. The main pulse MH denoted by 9*e* in FIG. 9 is applied after the pre-pulse.

Figure 9:
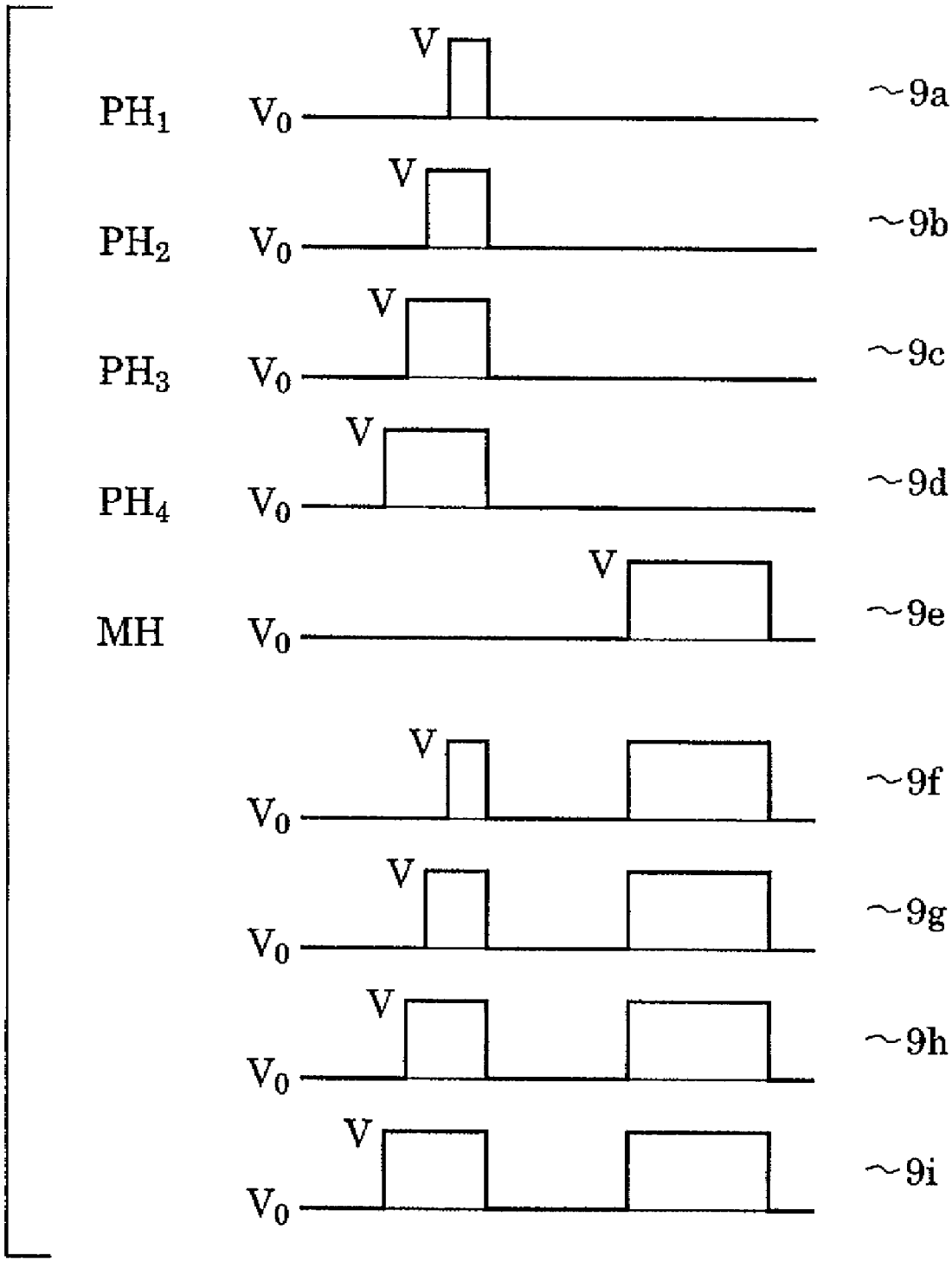
FIG. 9 is a diagram showing pre-pulses and a main pulse.

In FIG. 9, a pulse signal obtained by combining the pre-pulse $PH_1$ denoted by 9*a* and the main pulse MH denoted by 9*e* is denoted by 9*f*. Similarly, pulse signals obtained by combining $PH_2$ and MH, $PH_3$ and MH, and $PH_4$ and MH are denoted by 9*g*, 9*h*, and 9*i*, respectively.

Figure 10:
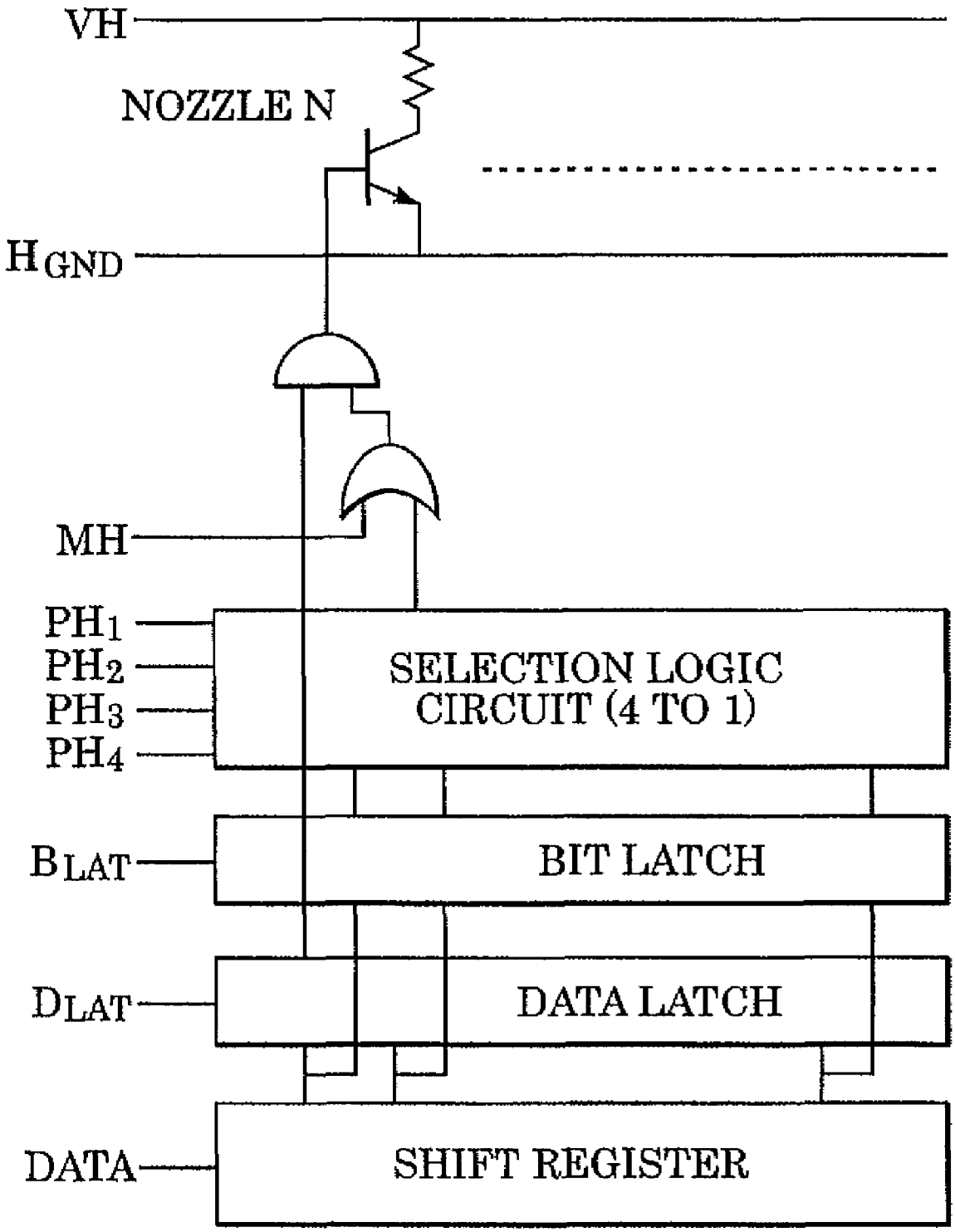
FIG. 10 is a diagram showing an example of a drive circuit.

FIG. 10 shows the structure of an electrical circuit used in the above-describe discharge amount control.

In FIG. 10, a signal line VH shows a power source of the inkjet head, and $H_{GND}$ shows a GND line for VH. In addition, MH shows a signal line for supplying the main pulse and $PH_1$ to $PH_4$ show signal lines for supplying the above-described pre-pulses. In addition, $B_{LAT}$ shows a signal line for latching the bit data used to select one of $PH_1$ to $PH_4$, $D_{LAT}$ is a signal line for latching data (image data) necessary for printing, and DATA is a signal line via which the bit data and the image data are transmitted to a shift register as serial data.

In the structure shown in FIG. 10, the bit data (selection bit data) shown in FIG. 7 is transmitted via the signal line DATA as serial data and is stored in the shift register. When the bit data for all of the nozzles is obtained, the signal $B_{LAT}$ is generated and the bit data is latched.

Next, the image data used for printing is similarly transmitted via the signal line DATA and is stored in the shift register. When the data for all of the nozzles is obtained, the signal $D_{LAT}$ is generated and the data is latched. First, the latched bit data is fed to a selection logic circuit which selects one of $PH_1$ to $PH_4$, and the selected pre-pulse signal and the main pulse signal MH are combined together. The thus combined signal and the print data are fed to an AND gate, and a transistor of a nozzle N is driven by the output from the AND gate. In addition, VH is applied to the resistor (heater board), so that the ink is discharged from the nozzle. This process is performed for all of the nozzles.

The signals obtained by combining the signal MH and the signals $PH_1$ to $PH_4$ are shown in FIG. 9 (9*f* to 9*i*). The amount of discharge is controlled by transmitting new bit data to the shift register and generating the $B_{LAT}$ signal at a desired time for changing the amount of discharge.

In the above-described example of drive control, one of four kinds of PH pulses is selected using the 2 bit data. The number of selectable pre-pulses can be increased by increasing the number of bits, and the precision of discharge amount control can be increased accordingly. However, the selection logic circuit becomes, of course, more complex when the number of selectable pre-pulses is increased.

In the above-described method, the amount of discharge is selected from four levels for each nozzle. However, since the detected temperature of the head corresponds to a relatively large area, different drive pulse signals are set between the nozzles of the chip N and the chip (N-1) in the band boundary regions.

Next, the operation of controlling the amount of discharge will be described below.

First, the head temperature detector 811 shown in FIG. 8 detects the temperature of each chip (in this example, the diode sensors are provided near the band-boundary nozzles). Then, the CPU 801 calculates the change (increase) in the amount of discharge caused by the temperature increase in each chip and determines the drive pulse signal for each chip.

With respect to the change in the amount of discharge due to the temperature increase, the relationship between the temperature and the amount of discharge in the head (chips) to be used is experimentally determined and a general equation shown below or a conversion table is stored in the correction data RAM 810 shown in FIG. 8 in advance.

$$\text{Amount of Discharge} = K \times \text{Temperature} \quad (1)$$

where K is a constant.

In bubble jet heads, the amount of discharge generally increases along with the temperature, and the amount of discharge changes substantially linearly with respect to the temperate in a certain temperature range. With respect to the head (chips) used in the present embodiment, it is experimentally determined that the amount of discharge increases about 0.8% when the temperature increases by 1° C.

In addition, the change in the amount of discharge obtained by switching the drive pulse signal as described above is also determined in advance. Accordingly, the increase in the amount of discharge caused by the temperature increase can be cancelled. More specifically, the variation in the amount of discharge can be reduced by selecting a drive pulse signal corresponding to the temperature.

When the above-described data is obtained in advance, drive pulse signals to be set for the nozzles in the band boundary regions of each chip can be determined on the basis of the detected head temperature. Although 2-bit data is used for selecting from four kinds of drive pulse signals in the present embodiment, the precision of discharge amount control can also be increased by increasing the number of bits. However, since the circuit structure becomes complicated and the cost is increased in such a case, the setting must be determined after clarifying the specification of the overall apparatus, the relationship between the temperature and the amount of discharge, etc.

In addition, in the above-described embodiment, the amount of discharge is changed by switching the pulse width of the drive pulse signal, and the voltage is maintained constant. However, similar effects are, of course, also obtained when the voltage is changed instead of the pulse width.

Second Embodiment

In a second embodiment, a bubble jet head is used as an inkjet head, and the number of ink drops discharged is changed by a discharge control unit on the basis of data obtained by detecting the temperature of the head.

Figure 11:
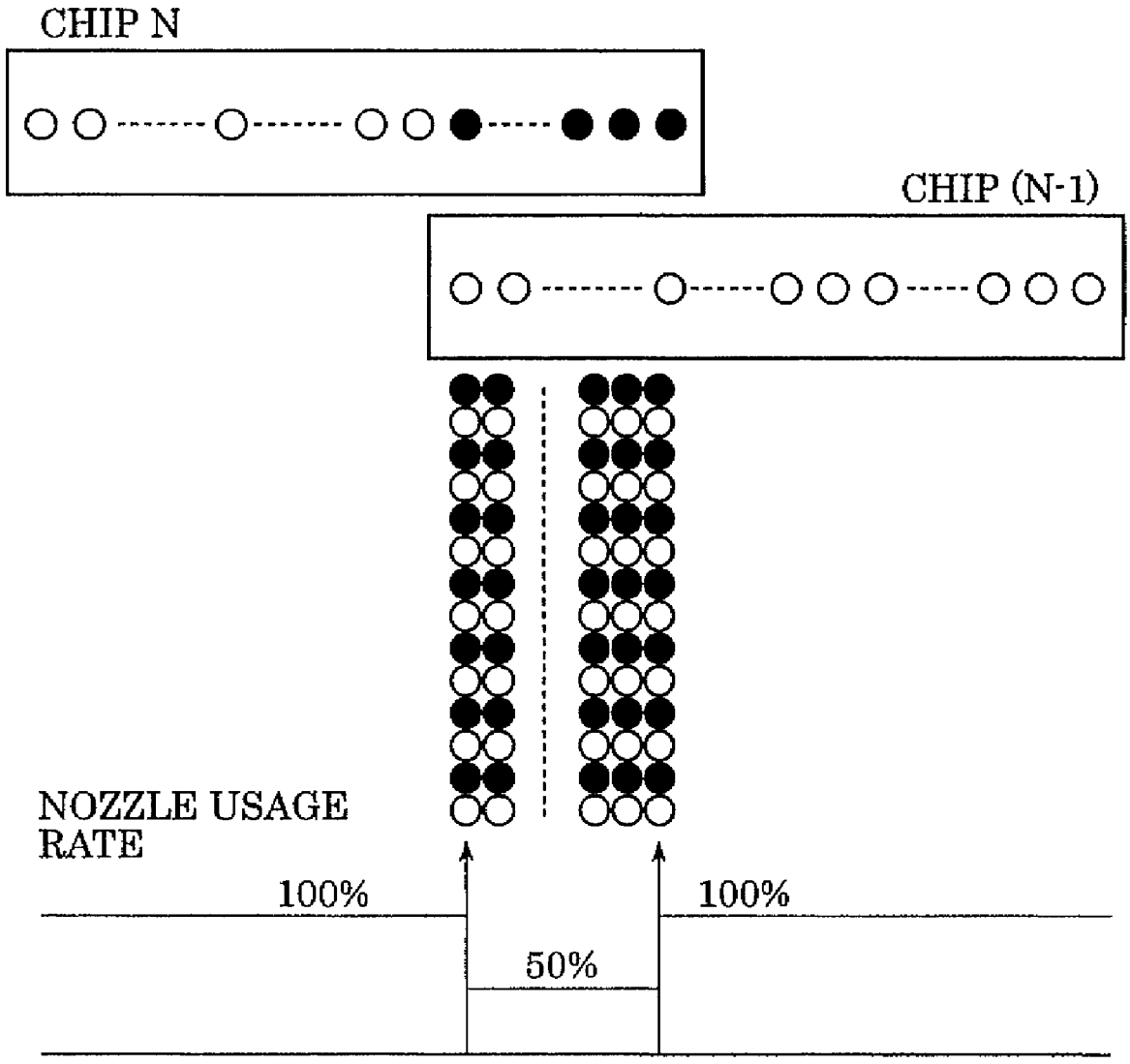
FIGS. 11, 12, and 13 are diagrams showing recording result in accordance with nozzle usage rates in a band boundary region between the adjacent head chips.

FIG. 11 shows an example of the state of dots recorded in a boundary region between two head chips. In the figure, the state of ink discharged by nozzles (the state of dots being recorded) in the band boundary region is shown.

The positional relationship between the two head chips shown in FIG. 11 is similar to that shown in FIG. 2. In order to facilitate understanding, the head chips are shown in FIG. 11 in the orientation different from that in FIG. 2.

FIG. 11 shows the state in which the temperature of each head chip is normal (the temperatures of the two head chips are both in a predetermined range and are substantially equal) and dots are evenly recorded by the nozzles of the chip N and the chip (N-1) in the band boundary region. More specifically, in the example shown in FIG. 11, the nozzles of the chip N and the nozzles of the chip (N-1) alternately discharge ink to form an image in the band boundary region, and the image in the band boundary region is formed with the nozzle usage rate set to 50% in each of the two head chips.

The nozzle usage rate refers to the rate using which the image data for forming an image is generated for the corresponding nozzle. In this case, the usage rate of the nozzles in the band boundary region is 50% in both of the head chips, and therefore it is assumed that the temperature increases by substantially the same amount in the head chips in this region. However, the temperature difference occurs between the chips due to the print duty in regions other than the band boundary region.

The reason for this is because the temperature distribution in each head chip becomes uniform in a relatively short time since the silicon substrate has high thermal conductivity, as described above.

The case is considered in which, for example, the temperature in the chip N is increased and the temperature difference between the chip N and the chip (N-1) exceeds a predetermined threshold while printing is performed with the nozzle usage rate shown in FIG. 11. In this case, the usage rate of the band-boundary nozzles in the chip N is reduced as shown in FIG. 12.

Figure 12:
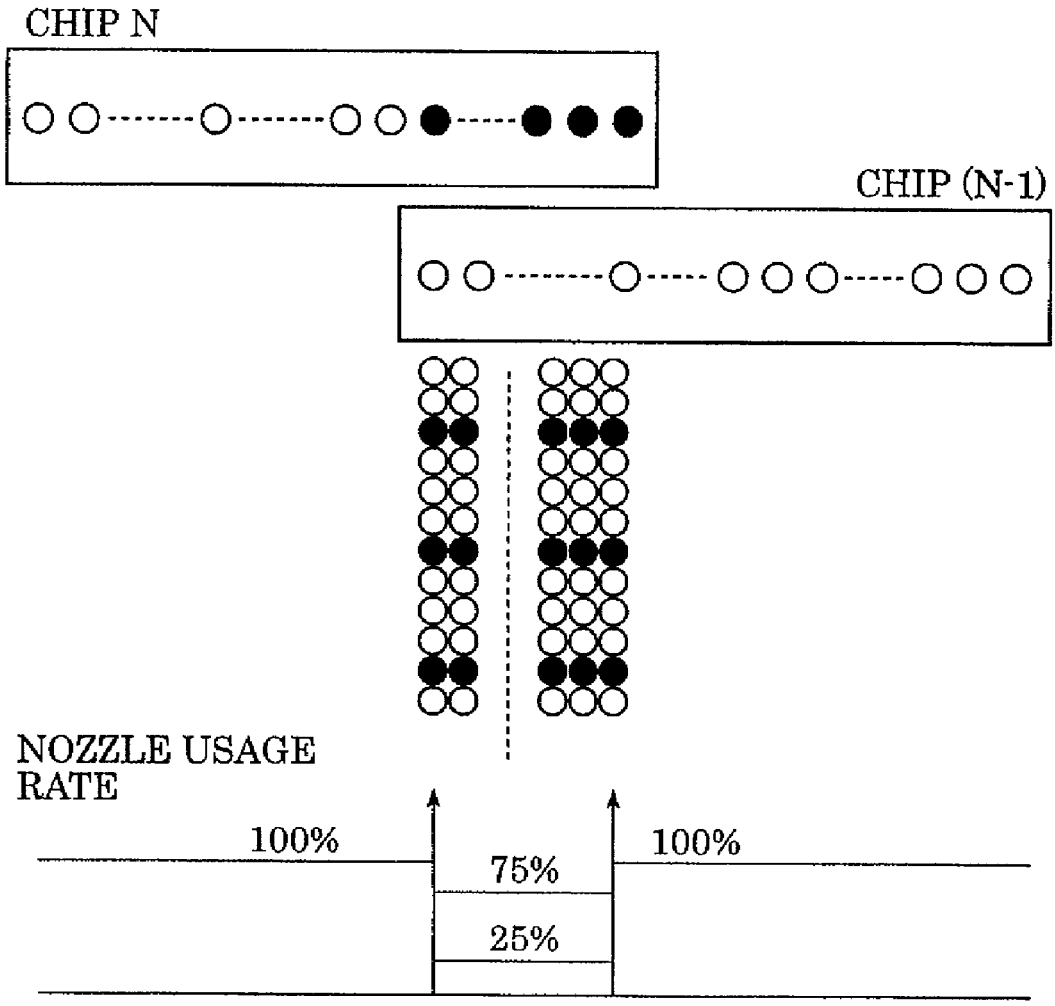

FIG. 12 shows an example of the nozzle usage rates in the state in which the temperature of the chip N is higher than that of the chip (N-1). In the example shown in FIG. 12, the number of ink drops discharged from the band-boundary nozzles in the chip N is reduced to half of that in the normal state (the state shown in FIG. 11). More specifically, the nozzle usage rate of the chip N in the band boundary region is set to 25%, while the nozzle usage rate of the chip (N-1) in the band boundary region is set to 75%.

The flow of the control is similar to that in the first embodiment. More specifically, first, the temperature of each chip is detected and the temperature difference between the chips is calculated. Then, the image processor 809 shown in FIG. 8 generates new image data such that the nozzle usage rate (the number of ink drops discharged from the nozzles) is changed in accordance with the result of calculation.

The basic characteristics regarding the temperature and the nozzle usage rate, that is, the data representing the relationship between the temperature difference and the change in the nozzle usage rate to be set, are experimentally determined in advance. The control is performed by storing the data in the correction data RAM 810 and referring to the stored data as necessary.

Figure 13:
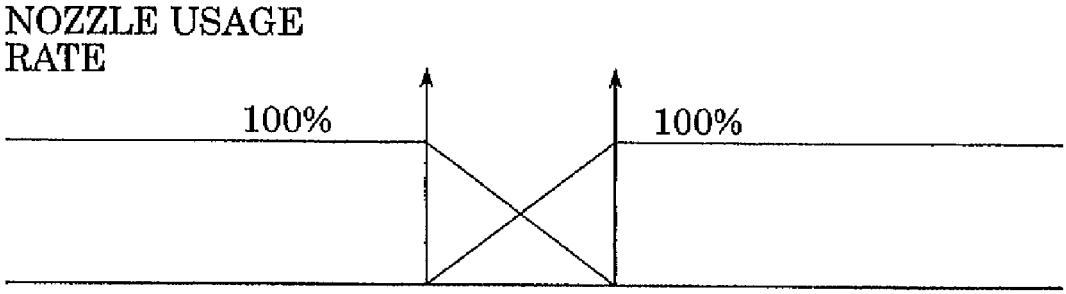

In the structure described with reference to FIGS. 11 and 12, the nozzle usage rate is constant over the band boundary region in each of the two head chips. In other words, all of the nozzles in the band boundary region are operated with the same usage rate in each head chip. However, the usage rate may also be changed gradually, as shown in FIG. 13. More specifically, the nozzle usage rate may be changed stepwise in the arrangement direction of the nozzles (the usage rate is changed linearly in the graph).

Although the nozzle usage rates of the two head chips in the band boundary region are set such that they sum up to 100% in the example shown in FIG. 13, the present invention is not limited to this. More specifically, the nozzle usage rates of the two head chips in the band boundary region may preferably be set such that the sum thereof is greater or less than 100% depending on the control. These settings are determined in the design phase of the apparatus, and any settings are possible within the scope of the present invention.

Figure 14:
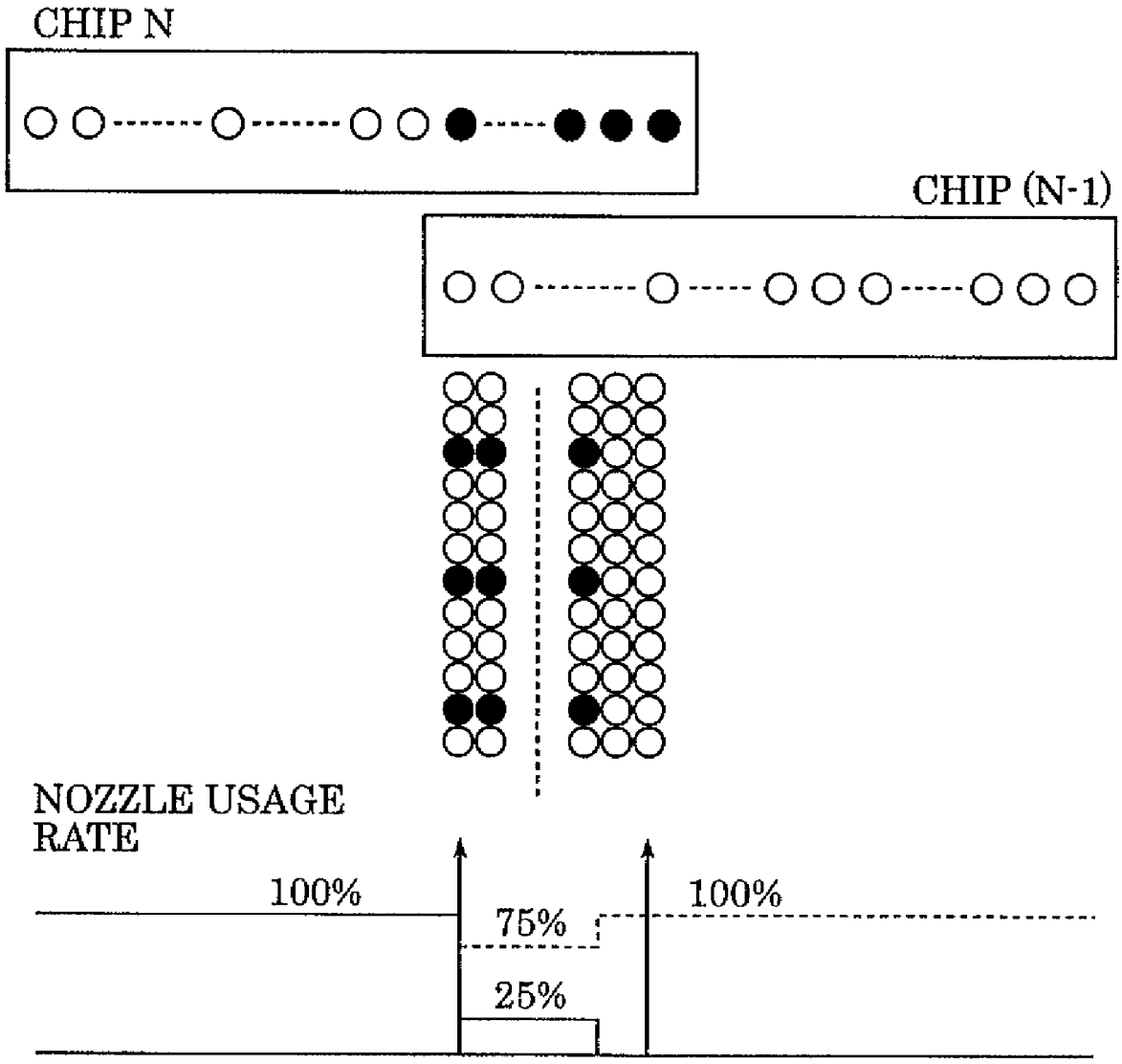
FIG. 14 is a diagram showing a recording result obtained when some of the nozzles in the band boundary region between the adjacent head chips are not used.

FIG. 14 shows as an extreme example of the nozzle usage rates. In this example, among the nozzles of the chip N corresponding to the band boundary region, the nozzles near the end are not used at all.

In the present embodiment, the image data corresponding to the band boundary region must be changed to control the number of ink drops discharged by each head chip in the band boundary region. Therefore, in the present embodiment, a plurality of kinds of mask image data must be stored in the correction data RAM 810 in advance. Each time an image corresponding to a single band is recorded, the temperature of each head chip is detected and the mask image data is selected in accordance with the detected temperature. Then, the nozzle usage rates for the next band boundary region are determined.

Third Embodiment

In the first and the second embodiments, the discharge control of the nozzles in the overlapping region is performed by directly detecting the temperature of each chip.

In a third embodiment, the discharge control is performed using the output from the print-duty-checking unit 812 shown in FIG. 8.

First, the image data to be recorded is expanded in the print-duty-checking unit 812. The print-duty-checking unit 812 has a large-capacity memory, and the number of ink drops discharged from each nozzle in the head assembly can be checked by expanding the image memory corresponding to a single page. The large-capacity memory may be, for example, a hard disc, a semiconductor memory such as DRAM, a flash memory, a card memory, etc. Here, the important information is the number of ink drops discharged in the regions outside the band boundary regions in each chip. The number of nozzles in the band boundary regions is normally smaller than the number of nozzles in the regions outside the band boundary regions, and therefore the temperature increase in each chip depends on the print duty of the nozzles outside the band boundary regions.

Similar to the above-described cases, the relationship between the print duty and the temperature increase is experimentally determined and the thus obtained data is stored in the RAM 810 in advance. When checking of the print duty is finished, the CPU 801 determines the discharge control necessary for that page by referring to the data stored in the RAM 810. The discharge control method may either be the method according to the first embodiment in which the amount of discharge itself is change or the method according to the second embodiment in which the number of ink drops discharged from the nozzles (nozzle usage rate) is changed.

Fourth Embodiment

In a fourth embodiment, in addition to the structure of the above-described first to third embodiments, a function of changing the amount of correction when the temperature difference between the two adjacent head chips is larger than a predetermined value and a function of determining the predetermined value in accordance with the kind of the recording medium being used are provided.

In general, the noticeability of the density difference on the recording medium varies depending on the kind of the recording medium. For example, when the same kind of printing is performed on a piece of normal paper and a piece of glossy paper, the density difference that is indiscernible on the normal paper may be discernible on the glossy paper.

Accordingly, a unit for detecting the kind of the recording medium (for example, a reflective photosensor or the like) is provided, and the correcting method is determined on the basis of the recording medium that is detected automatically. Thus, the load on the apparatus is reduced.

Other Embodiments

The present invention may be applied to a system including a plurality of devices (for example, a host computer, an interface device, a reader, a printer, etc.), as well as to an apparatus consisting of a single device (for example, a copy machine, a facsimile machine, etc.)

The object of the present invention may also be achieved by supplying a system or an apparatus with a storage medium (or recording medium) which stores a program code of a software program for implementing the functions of the above-described embodiments and causing a computer (or CPU or MPU) of the system or the apparatus to read and execute the program code stored in the storage medium. In such a case, the program code itself which is read from the storage medium provides the functions of the above-described embodiments, and thus the storage medium which stores the program code constitutes the present invention. In addition, the functions of the above-described embodiments may be achieved not only by causing the computer to read and execute the program code but also by causing an operating system (OS) running on the computer to execute some or all of the process on the basis of instructions of the program code.

Furthermore, the functions of the above-described embodiments may also be achieved by writing the program code read from the storage medium to a memory of a function extension card inserted in the computer or a function extension unit connected to the computer and causing a CPU of the function extension card or the function extension unit to execute some or all of the process on the basis of instructions of the program code.

When the present invention is applied to the storage medium, the memory medium stores a program code for executing the discharge amount control method according to the above-described embodiments and various tables.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus which records an image on a recording medium by discharging ink from a plurality of head chips disposed in a recording head, each head chip having multiple nozzles and thermal-energy-generating unit configured to discharge ink through the nozzles by thermal energy, the apparatus comprising:

a temperature-detecting unit configured to detect the temperature of each of the head chips disposed in the recording head; and an adjusting unit configured to adjust the discharge of ink from only band-boundary nozzles corresponding to a boundary region between two adjacent head chips for each of the head chips on the basis of the temperature detected by the temperature-detecting unit, wherein, when a temperature difference between the adjacent two chips exceeds a predetermined threshold, the adjusting unit adjusts the band-boundary nozzles of each of the two adjacent head chips in a boundary region between the two adjacent head chips such that a usage rate of a chip having a higher temperature is lower than a usage rate of a chip having a lower temperature.

2. The apparatus according to claim 1, further comprising:

obtaining means for obtaining the amount of ink discharged from each of the head chips on the basis of the temperature of each head chip detected by the temperature-detecting unit, wherein the adjusting unit adjusts the discharge of ink from the band-boundary nozzles of two adjacent head chips in a boundary region between the two adjacent head chips on the basis of the result of the obtaining means.

3. The apparatus according to claim 1, further comprising:

estimating means for estimating a temperature to which the temperature of each head chip is increased on the basis of print duty of each head chip corresponding to the image to be recorded; and obtaining means for obtaining the amount of ink discharged from each of the head chips on the basis of the temperature estimated by the estimating means, wherein the adjusting unit adjusts the discharge of ink from the band-boundary nozzles of two adjacent head chips in a boundary region between the two adjacent head chips on the basis of the amount of discharge obtained by the obtaining means.

4. The apparatus according to claim 1, wherein the adjusting means changes the number of ink drops discharged from the band-boundary nozzles of each of two adjacent head chips in a boundary region between the two adjacent head chips.

5. The apparatus according to claim 1, wherein the adjusting unit changes the number of band-boundary nozzles of each of two adjacent head chips from which the ink is discharged in a boundary region between the two adjacent head chips, recording positions of the band-boundary nozzles of the two adjacent head chips overlapping each other in the boundary region.

6. The apparatus according to claim 1, further comprising:

drive control means for controlling a voltage of an electric signal applied to the thermal-energy-generating means for a time for which the electric signal is applied, wherein the adjusting unit changes the volume of each ink drop being discharged using the drive control means.

7. The apparatus according to claim 1, wherein the nozzles in each head chip are arranged in a line and the head chips are disposed along the arrangement direction of the nozzles in the recording head.

8. The apparatus according to claim 7, wherein the head chips are disposed in the recording head such that two adjacent head chips are shifted from each other in a direction different from the arrangement direction of the nozzles and recording areas of the two adjacent head chips overlap each other.

9. An inkjet recording method which records an image on a recording medium by discharging ink from a plurality of head chips disposed in a recording head, each head chip having multiple nozzles and a thermal-energy-generating unit configured to discharge ink through the nozzles by thermal energy, the method comprising:

a temperature-detecting step of detecting the temperature of each of the head chips disposed in the recording head; and an adjusting step of adjusting the discharge of ink from only band-boundary nozzles corresponding to a boundary region between two adjacent head chips for each of the head chips on the basis of the temperature detected in the temperature-detecting step, wherein, when a temperature difference between the adjacent two chips exceeds a predetermined threshold, the adjusting step adjusts the band-boundary nozzles of each of the two adjacent head chips in a boundary region between the two adjacent head chips such that a usage rate of a chip having a higher temperature is lower than a usage rate of a chip having a lower temperature.

10. The method according to claim 9, further comprising:

an obtaining step of obtaining the amount of ink discharged from each of the head chips on the basis of the temperature of each head chip detected in the temperature-detecting step, wherein, in the adjusting step, the discharge of ink from the band-boundary nozzles of two adjacent head chips in a boundary region between the two adjacent head chips is adjusted on the basis of the result of the obtaining step.

11. The method according to claim 9, further comprising:

an estimating step of estimating a temperature to which the temperature of each head chip is increased on the basis of print duty of each head chip corresponding to the image to be recorded; and an obtaining step of obtaining the amount of ink discharged from each of the head chips on the basis of the temperature estimated in the estimating step, wherein, in the adjusting step, the discharge of ink from the band-boundary nozzles of two adjacent head chips in a boundary region between the two adjacent head chips is adjusted on the basis of the amount of discharge obtained in the obtaining step.

12. The method according to claim 9, wherein the number of band-boundary nozzles of each of two adjacent head chips from which the ink is discharged in a boundary region between the two adjacent head chips is changed in the adjusting step, recording positions of the band-boundary nozzles of the two adjacent head chips overlapping each other in the boundary region.

13. The method according to claim 9, wherein the volume each of ink drops discharged from the band-boundary nozzles of two adjacent head chips in a boundary region between the two adjacent head chips is changed in the adjusting step.

14. A program for causing a computer of an inkjet recording apparatus to execute the method according to claim 9.

* * * * *